US009548016B2

(12) United States Patent
Lee et al.

(10) Patent No.: US 9,548,016 B2
(45) Date of Patent: Jan. 17, 2017

(54) METHOD OF DRIVING DISPLAY PANEL AND DISPLAY APPARATUS FOR PERFORMING THE SAME

(71) Applicant: Samsung Display Co., Ltd., Yongin (KR)

(72) Inventors: Hyun-Dae Lee, Hwaseong-si (KR); Kyoung-Won Lee, Seoul (KR); Eun-Ho Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 163 days.

(21) Appl. No.: 14/609,553

(22) Filed: Jan. 30, 2015

(65) Prior Publication Data

US 2016/0027363 A1 Jan. 28, 2016

(30) Foreign Application Priority Data

Jul. 22, 2014 (KR) ..... 10-2014-0092860

(51) Int. Cl.
*G09G 3/20* (2006.01)

(52) U.S. Cl.
CPC .... *G09G 3/2003* (2013.01); *G09G 2300/0452* (2013.01); *G09G 2310/0297* (2013.01); *G09G 2310/08* (2013.01); *G09G 2320/0242* (2013.01); *G09G 2320/0666* (2013.01); *G09G 2320/103* (2013.01); *G09G 2330/023* (2013.01)

(58) Field of Classification Search
CPC ..... G09G 3/20; G09G 3/2003; G09G 3/2096; G09G 2320/103; G09G 2310/08; G09G 2330/023; G09G 2300/0452; G09G 2320/242; G09G 2310/0297; G09G 2320/0666; G09G 2320/0613
See application file for complete search history.

(56) References Cited

U.S. PATENT DOCUMENTS 6,822,642 B2 * 11/2004 Chou ..... G09G 3/3648 345/204
2007/0296668 A1 * 12/2007 Kim ..... G09G 3/3611 345/89

(Continued)

FOREIGN PATENT DOCUMENTS

KR 10-2004-0016029 2/2004
KR 10-2004-0078298 9/2004

(Continued)

*Primary Examiner* — Ilana Spar
*Assistant Examiner* — Jeffrey S Steinberg
(74) *Attorney, Agent, or Firm* — H.C. Park & Associates, PLC

(57) ABSTRACT

A method of driving a display panel includes determining whether an input data signal represents a video image or a static image, determining whether the input data signal has a color difference generating pattern and outputting an output data signal. The output data signal has a first frequency if the input data signal represents a video image. The output data signal has the first frequency if the input data signal represents a static image and the input data signal includes the color difference generating pattern. The output data signal has a second frequency lower than the first frequency if the input data signal represents a static image and the input data signal does not include the color difference generating pattern.

19 Claims, 13 Drawing Sheets

(56) References Cited

U.S. PATENT DOCUMENTS

| | | | | |
|---|---|---|---|---|
| 2009/0059147 | A1* | 3/2009 | Igeta | G02F 1/133512 349/124 |
| 2009/0066616 | A1* | 3/2009 | Uchino | G09G 3/3233 345/77 |
| 2011/0285753 | A1* | 11/2011 | Park | G09G 3/2003 345/690 |
| 2012/0162159 | A1* | 6/2012 | Kim | G09G 3/3233 345/204 |
| 2014/0152630 | A1* | 6/2014 | Koyama | G09G 3/3648 345/205 |
| 2015/0109268 | A1* | 4/2015 | Huang | G09G 3/36 345/206 |
| 2015/0228216 | A1 | 8/2015 | Lee et al. | |

FOREIGN PATENT DOCUMENTS

| | | |
|---|---|---|
| KR | 10-2009-0106358 | 10/2009 |
| KR | 10-2015-0094881 | 8/2015 |

* cited by examiner

FIG. 7A

| SEG | TYPE |
|---|---|
| 1 | 0 |
| 4 | 0 |
| 5 | 1 |
| | |

FIG. 7B

| SEG | TYPE |
|---|---|
| 1 | 1 |
| 4 | 1 |
| | |

FIG. 7C

| SEG | TYPE |
|---|---|
| 4 | 0 |
| | |

FIG. 7D

| SEG | TYPE |
|---|---|
| 4 | 1 |
| | |

METHOD OF DRIVING DISPLAY PANEL AND DISPLAY APPARATUS FOR PERFORMING THE SAME

CROSS-REFERENCE TO RELATED APPLICATION

This application claims priority from and the benefit under 35 U.S.C. §119 of Korean Patent Application No. 10-2014-0092860, filed on Jul. 22, 2014, which is herein incorporated by reference for all purposes as if fully set forth herein.

BACKGROUND

Field

Exemplary embodiments of the present inventive concept relate to a method of driving a display panel and a display apparatus for performing the method. More particularly, exemplary embodiments of the present inventive concept relate to a method of driving a display panel for reducing a power consumption and improving a display quality and a display apparatus for performing the method.

Discussion of the Background

There has been research to minimize a power consumption of an IT product, such as a tablet personal computer (PC) and a phablet PC.

To decrease the size of an IT product which includes a display panel, a power consumption of the display panel may be decreased. When the display panel displays a static image, the display panel may be driven in a relatively low frequency so that power consumption of the display panel is reduced.

When the display panel is driven in a relatively low frequency, however, a color difference for a specific image pattern may be generated because of the difference between a luminance of a positive polarity and a luminance of a negative polarity of each pixel. Thus, the display quality of the display panel may deteriorate.

SUMMARY

Exemplary embodiments of the present inventive concept provide a method of driving a display panel capable of reducing power consumption and improving a display quality of the display panel.

Exemplary embodiments of the present inventive concept provide a display apparatus for performing the above-mentioned method.

Additional aspects will be set forth in part in the description which follows and, in part, will be apparent from the description, or may be learned by practice of the presented embodiments.

In accordance with an exemplary embodiment, a method of driving a display panel includes determining whether an input data signal represents a video image or a static image, determining whether the input data signal has a color difference generating pattern, the color difference generating pattern generating a color difference if polarities of associated pixels are inverted, and outputting an output data signal. The output data signal may have a first frequency if the input data signal represents a video image, have the first frequency if the input data signal represents a static image and the input data signal includes the color difference generating pattern, and have a second frequency lower than the first frequency if the input data signal represents a static image and the input data signal does not include the color difference generating pattern.

In accordance with an exemplary embodiment, a method of driving a display panel includes determining whether an input data signal represents a video image or a static image, determining whether the input data signal has a color difference generating pattern, the color difference generating pattern generating a color difference if polarities of associated pixels are inverted, outputting an output data signal. The output data signal may have a first frequency if the input data signal represents a video image, have a second frequency lower than the first frequency if the input data signal represents a static image. The method may determine an inversion driving method of the display panel according to the determination whether the input data signal represents a video image or a static image and the determination whether the input data signal includes the color difference generating pattern.

In accordance with an exemplary embodiment, a display apparatus includes a display panel, a timing controller, and a data driver. The display panel is configured to display an image. The timing controller may be configured to determine whether an input data signal represents a video image or a static image, to determine whether the input data signal includes a color difference generating pattern, the color difference generating pattern generating a color difference if polarities of associated pixels are inverted, to output an output data signal. The output data signal may have a first frequency if the input data signal represents a video image, have the first frequency if the input data signal represents a static image and the input data signal includes the color difference generating pattern, and have a second frequency lower than the first frequency if the input data signal represents a static image and the input data signal does not include the color difference generating pattern. The data driver may be configured to generate a data voltage based on the output data signal and to output the data voltage to the display panel.

According to aspects, in a method of driving a display panel and a display apparatus for performing the display panel, a driving frequency is adjusted according to an image displayed on the display panel so that the power consumption of the display apparatus is reduced. According to aspects, when an input data signal includes a color difference generating pattern, the image is displayed in a relatively high frequency or an inversion method of the display panel is converted so that the color difference may be prevented or reduced. Thus, a display quality of the display panel may be improved.

If a polarity of a pixel is inverted from a positive polarity to a negative polarity or from the negative polarity to the positive polarity, a color difference may be generated because of the difference between a luminance of the pixel having the positive polarity and a luminance of the pixel having the negative polarity.

If polarities of a plurality of pixels are inverted in a specific inversion method, e.g., a dot inversion method, an average color difference of the plurality of pixels may be generated or may not be generated depending upon several factors. The factors may include an arrangement of different color pixels, an inversion method, an output signal frequencies, and the like.

In order to improve a display quality by reducing such color difference, different configurations may be applicable. Hereinafter, various embodiments will be provided, but the present inventive concept is not limited thereto.

BRIEF DESCRIPTION OF THE DRAWINGS

The above and other features and advantages of the present inventive concept will become more apparent by describing in detailed exemplary embodiments thereof with reference to the accompanying drawings.

FIG. 7A to FIG. 7D are conceptual diagrams illustrating data stored in a register of FIG. 4 according to an exemplary embodiment of the present inventive concept.

DETAILED DESCRIPTION OF THE ILLUSTRATED EMBODIMENTS

Hereinafter, exemplary embodiments of the present inventive concept will be explained in detail with reference to the accompanying drawings.

Figure 1:
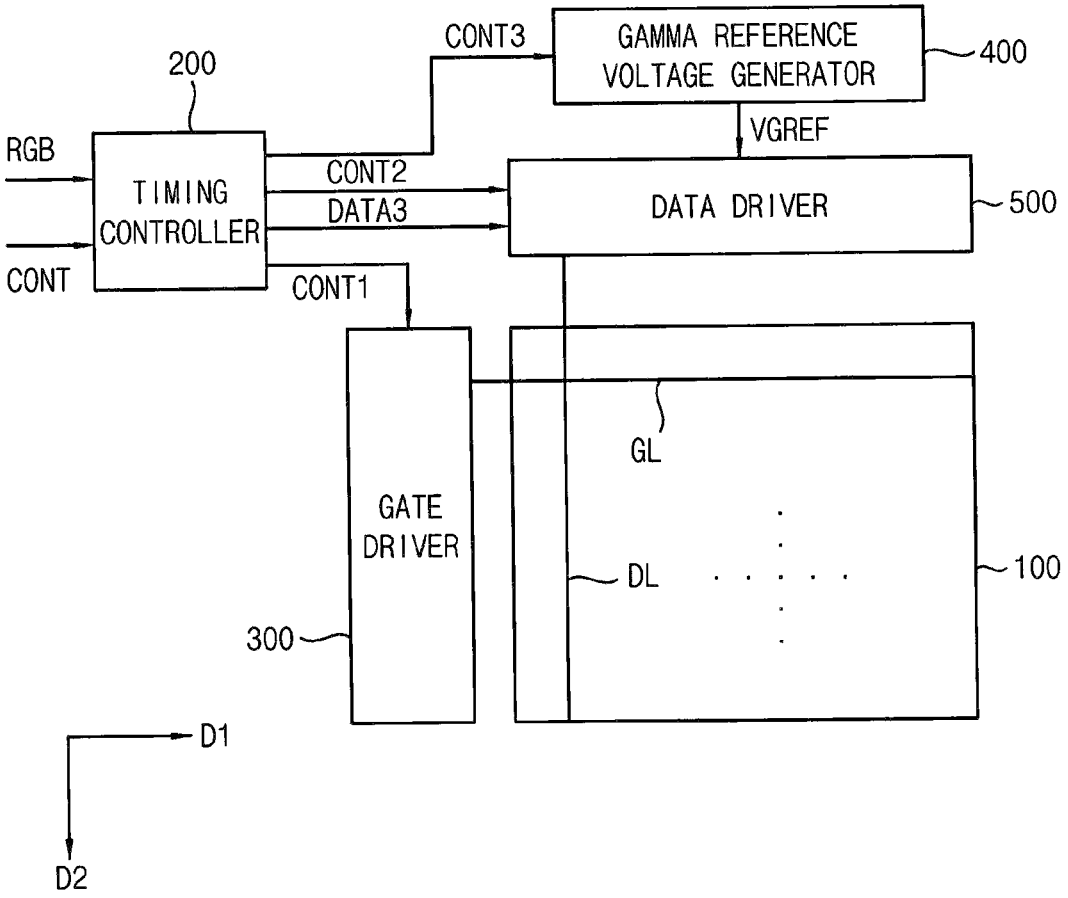
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400, and a data driver 500.

The display panel 100 has a display region on which an image is displayed and a peripheral region adjacent to the display region.

The display panel 100 includes a plurality of gate lines GL, a plurality of data lines DL and a plurality of subpixels connected to the gate lines GL and the data lines DL. The gate lines GL extend in a first direction D1 and the data lines DL extend in a second direction D2 crossing the first direction D1 as shown in FIG. 1. The second direction D2 may be perpendicular to the first direction D1.

Each subpixel includes a switching element (not shown), a liquid crystal capacitor (not shown) and a storage capacitor (not shown). The liquid crystal capacitor and the storage capacitor are electrically connected to the switching element. The subpixels may be disposed in a matrix form.

The timing controller 200 receives input image data RGB and an input control signal CONT from an input control signal provider, e.g., an external apparatus, (not shown). The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DATA3 based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA3 based on the input image data RGB. The timing controller 200 outputs the data signal DATA3 to the data driver 500.

The timing controller 200 may determine whether the input image data RGB represents a video image or a static image. The timing controller 200 may determine whether the input image data RGB includes a color difference generating pattern which generates a color difference due to the difference between a luminance of a pixel in a positive polarity and a luminance of the pixel in a negative polarity.

The timing controller 200 may adjust a driving frequency of the display panel 100 according to a determination whether the input image data RGB represents a video image or a static image and a determination whether the input image data RGB includes the color difference generating pattern or not.

The timing controller 200 generates the third control signal CONT3 for controlling an operation of the gamma reference voltage generator 400 based on the input control signal CONT, and outputs the third control signal CONT3 to the gamma reference voltage generator 400.

A structure and an operation of the timing controller 200 will be described with reference to FIG. 2 to FIG. 7D in detail.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly mounted on the display panel 100, or may be connected to the display panel 100 as a tape carrier package (TCP) type or the like. Alternatively, the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA3.

In an exemplary embodiment, the gamma reference voltage generator 400 may be disposed in the timing controller 200, or in the data driver 500.

The data driver 500 receives the second control signal CONT2 and the data signal DATA3 from the timing controller 200, and receives the gamma reference voltages VGREF from the gamma reference voltage generator 400. The data driver 500 converts the data signal DATA3 into data voltages having an analog type using the gamma reference voltages VGREF. The data driver 500 outputs the data voltages to the data lines DL.

The data driver 500 may be directly mounted on the display panel 100, or be connected to the display panel 100 in a TCP type or the like. Alternatively, the data driver 500 may be integrated on the display panel 100.

Figure 2:
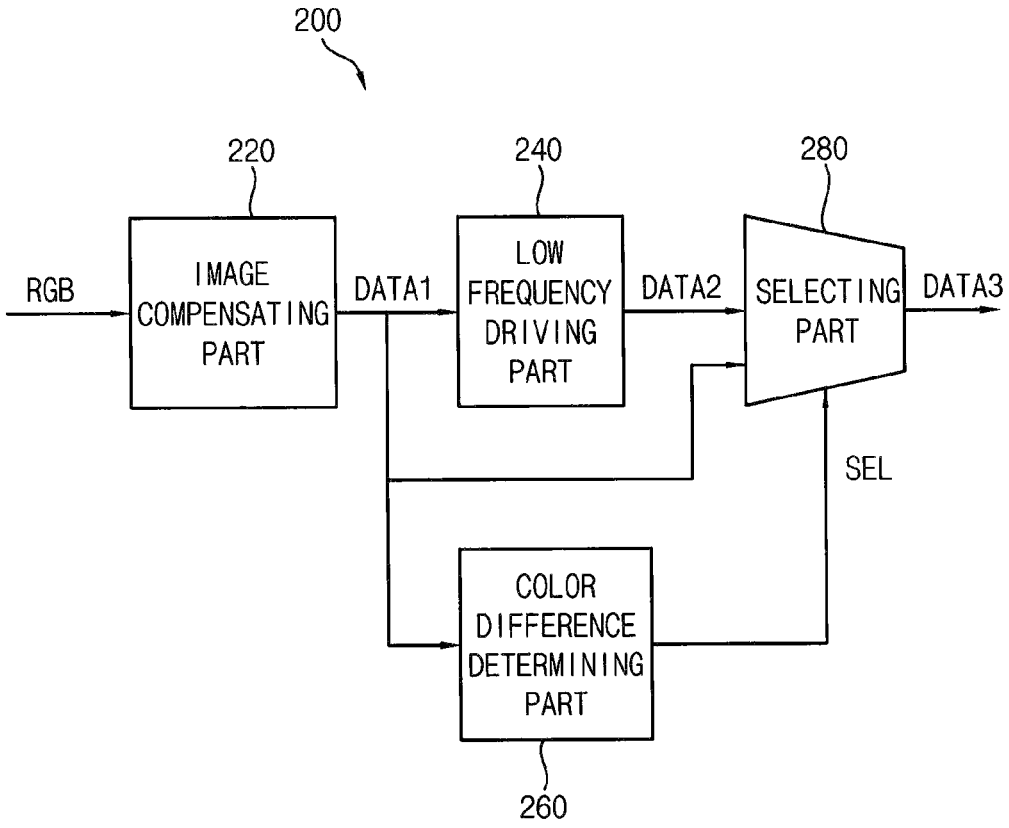
FIG. 2 is a block diagram illustrating a timing controller of FIG. 1 according to an exemplary embodiment of the present inventive concept.
Figure 3A:
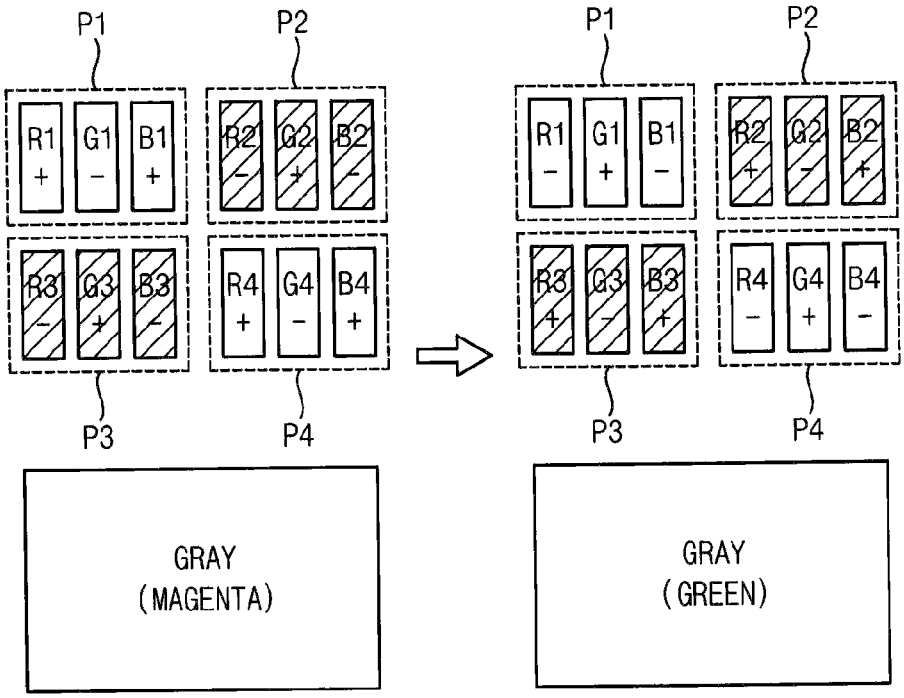
FIG. 3A, FIG. 3B, and FIG. 3C are conceptual diagrams illustrating color difference generating patterns determined by a color difference determining part of FIG. 2 according to an exemplary embodiment of the present inventive concept.
Figure 3B:
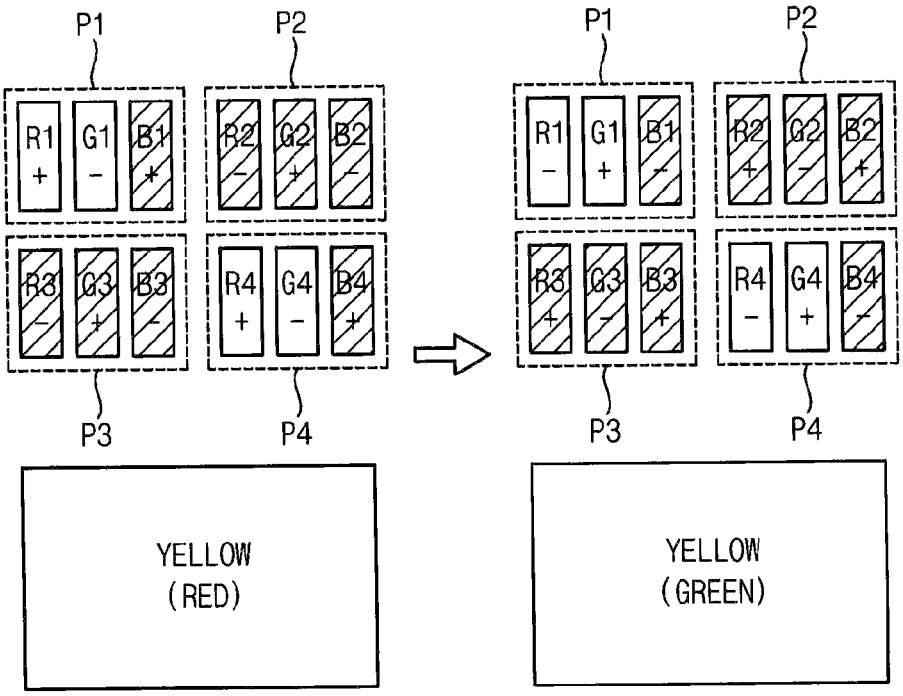
Figure 3C:
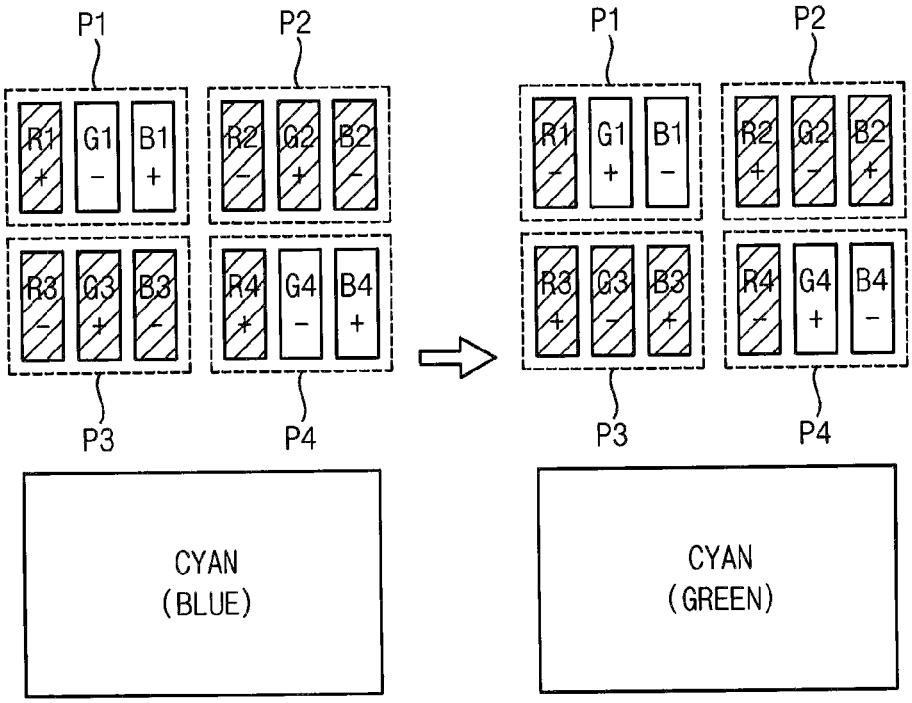

FIG. 2 is a block diagram illustrating the timing controller 200 of FIG. 1. FIGS. 3A, 3B and 3C are conceptual diagrams illustrating color difference generating patterns determined by a color difference determining part 260 of FIG. 2.

Referring to FIG. 1 to FIG. 3C, the timing controller 200 includes an image compensating part 220, a low frequency driving part 240, a color difference determining part 260, and a selecting part 280.

The image compensating part 220 compensates grayscale data of the input image data RGB and rearranges the input image data RGB to generate an input data signal DATA1 to correspond to a data type of the data driver 500. The input data signal DATA1 may have a digital type. The image compensating part 220 outputs the input data signal DATA1 to the low frequency driving part 240.

For example, the image compensating part 220 may include an adaptive color correcting part (not shown) and a dynamic capacitance compensating part (not shown).

The adaptive color correcting part receives the grayscale data of the input image data RGB, and operates an adaptive color correction ("ACC"). The adaptive color correcting part may compensate the grayscale data using a gamma curve.

The dynamic capacitance compensating part operates a dynamic capacitance compensation ("DCC"), which compensates the grayscale data of present frame data using previous frame data and the present frame data.

The low frequency driving part 240 receives the input data signal DATA1. The low frequency driving part 240 determines whether the input data signal DATA1 represents a video image or a static image. When the input data signal DATA1 represents a video image, an intermediate data signal DATA2 having a first frequency is generated. When the input data signal DATA1 represents a static image, an intermediate data signal DATA2 having a second frequency is generated.

For example, the first frequency may be 60 Hz. For example, the second frequency may be 1 Hz. The first frequency and the second frequency may vary according to the image of the input data signal DATA1.

The color difference determining part 260 receives the input data signal DATA1. The color difference determining part 260 determines whether the input data signal DATA1 includes the color difference generating pattern or not. The color difference determining part 260 determines a selection signal SEL according to whether the input data signal DATA1 includes the color difference generating pattern or not. The color difference determining part 260 outputs the selection signal SEL to the selecting part 280.

A structure and an operation of the color difference determining part 260 will be described with reference to FIG. 4 to FIG. 7D in detail.

The selecting part 280 receives the input data signal DATA1 from the image compensating part 220, the intermediate data signal DATA2 from the low frequency driving part 240 and the selection signal SEL from the color difference determining part 260. The selecting part 280 selects one of the input data signal DATA1 and the intermediate data signal DATA2 to generate an output data signal DATA3. The selecting part 280 outputs the output data signal DATA3 to the data driver 500.

When the input data signal DATA1 includes the color difference generating pattern, the selecting part 280 selects the input data signal DATA1 having the first frequency as the output data signal DATA3. When the input data signal DATA1 does not include the color difference generating pattern, the selecting part 280 selects the intermediate data signal DATA2 having the second frequency as the output data signal DATA3. Thus, the color difference may be reduced by controlling the frequency of the output control signal if a color difference generating pattern is detected for a static image.

Even though the input data signal DATA1 represents a static image, if the input data signal DATA1 includes the color difference generating pattern, the display panel 100 is driven in a high frequency (e.g. the first frequency) so that an observer does not recognize the color difference.

For example, the selecting part 280 includes a multiplexer including a first input terminal receiving the input data signal DATA1, a second input terminal receiving the intermediate data signal DATA2, a control terminal receiving the selection signal SEL, and an output terminal outputting the output data signal DATA3.

In FIG. 3A to FIG. 3C, the display panel 100 includes a first pixel P1, a second pixel P2 adjacent to the first pixel P1 in the first direction D1 defined in FIG. 1, a third pixel P3 adjacent to the first pixel P1 in the second direction D2 defined in FIG. 1, a fourth pixel P4 adjacent to the second pixel P2 in the second direction D2.

The first pixel P1 includes a first red subpixel R1, a first green subpixel G1 and a first blue subpixel B1, which are sequentially disposed in the first direction D1.

The second pixel P2 includes a second red subpixel R2, a second green subpixel G2 and a second blue subpixel B2, which are sequentially disposed in the first direction D1.

The third pixel P3 includes a third red subpixel R3, a third green subpixel G3 and a third blue subpixel B3, which are sequentially disposed in the first direction D1.

The fourth pixel P4 includes a fourth red subpixel R4, a fourth green subpixel G4 and a fourth blue subpixel B4, which are sequentially disposed in the first direction D1.

For example, the display panel 100 is driven in a dot inversion method in each subpixel along the first direction D1 and the second direction D2.

For example, during a first frame, the first red subpixel R1, the first blue subpixel B1 and the second green subpixel G2 have a positive polarity, and the first green subpixel G1, the second red subpixel R2 and the second blue subpixel B2 have a negative polarity in a first row. During the first frame, the third green subpixel G3, the fourth red subpixel R4 and the fourth blue subpixel B4 have a positive polarity, and the third red subpixel R3, the third blue subpixel B3 and the fourth green subpixel G4 have a negative polarity in a second row.

For example, during a second frame, the first red subpixel R1, the first blue subpixel B1 and the second green subpixel G2 have a negative polarity, and the first green subpixel G1, the second red subpixel R2 and the second blue subpixel B2 have a positive polarity in a first row. During the second frame, the third green subpixel G3, the fourth red subpixel R4 and the fourth blue subpixel B4 have a negative polarity, and the third red subpixel R3, the third blue subpixel B3 and the fourth green subpixel G4 have a positive polarity in the second row.

According to the color characteristics of the display panel 100, a luminance of the pixel having a positive polarity may be different from a luminance of the pixel having a negative polarity. For example, a luminance of the pixel having a positive polarity may be greater than a luminance of the pixel having a negative polarity. When the display panel 100 is driven in a high frequency (e.g. 60 Hz), the difference between the luminance of a positive pixel and the luminance of a negative pixel may not be recognized by a user of the display. However, when the display panel 100 is driven in a low frequency (e.g. 1 Hz), the color difference due to the difference between the luminance of a positive pixel and the luminance of a negative pixel is more likely to be recognized by the user in specific color difference generating patterns.

When all subpixels of the second and third pixels P2 and P3 have relatively low grayscales, the green subpixels G1 and G4 of the first and fourth pixels P1 and P4 commonly have relatively high grayscales and the red subpixels R1 and R4 or the blue subpixels B1 and B4 of the first and fourth pixels P1 and P4 commonly have relatively high grayscales, the color difference determining part 260 may determine the color difference generating pattern.

For example, the relatively high grayscale is equal to or greater than 100 grayscales when the maximum grayscale is 255 grayscales. The relatively high grayscale may be defined as a range between 100 grayscales to 200 grayscales. In the grayscale exceeding 200 grayscales, the difference between a luminance of the positive pixel and a luminance of the negative pixel may decrease so that the color difference may not be recognized by a user.

For example, the relatively low grayscale is equal to or less than 70 grayscales when the maximum grayscale is 255 grayscales. The relatively low grayscale may be defined as a range between zero to 70 grayscales.

FIG. 3A illustrates a white checker pattern. All subpixels of the second and third pixels P2 and P3 have relatively low grayscales so that the second and third pixels P2 and P3 represent black. All subpixels of the first and fourth pixels P1 and P4 have relatively high grayscales so that the first and fourth pixels P1 and P4 represent white. The first to fourth pixels P1 to P4 may represent gray as an average color.

When the display panel 100 represents the white checker pattern of FIG. 3A in the relatively low frequency, the red and blue subpixels R1, B1, R4 and B4 of the first and fourth pixels P1 and P4 have a positive polarity but the green subpixels G1 and G4 of the first and fourth pixels P1 and P4 have a negative polarity during a first frame. In contrast, the red and blue subpixels R1, B1, R4 and B4 of the first and fourth pixels P1 and P4 have a negative polarity but the green subpixels G1 and G4 of the first and fourth pixels P1 and P4 have a positive polarity during a second frame so that the color difference due to the difference of the luminance of the positive pixel and the luminance of the negative pixel may be generated.

For example, during the first frame, the luminance components of the red and blue subpixels R1, R4, B1 and B4 are relatively higher than the luminance components of the green subpixels G1 and G4 compared to the second frame so that the display panel 100 may display gray oriented to magenta.

For example, during the second frame, the luminance components of the green subpixels G1 and G4 are relatively higher than the luminance components of the red and blue subpixels R1, R4, B1, and B4 compared to the first frame so that the display panel 100 may display gray oriented to green.

FIG. 3B illustrates a yellow checker pattern. All subpixels of the second and third pixels P2 and P3 have relatively low grayscales so that the second and third pixels P2 and P3 represent black. Blue subpixels B1 and B4 of the first and fourth pixels P1 and P4, respectively, have relatively low grayscales or medium grayscales, but do not have relatively high grayscales. Red and green subpixels R1, G1, R4, and G4 of the first and fourth pixels P1 and P4 have relatively high grayscales so that the first and fourth pixels P1 and P4 represent yellow. The first to fourth pixels P1 to P4 may represent dark yellow as an average color.

When the display panel 100 represents the yellow checker pattern of FIG. 3B in the relatively low frequency, the red subpixels R1 and R4 of the first and fourth pixels P1 and P4 have a positive polarity but the green subpixels G1 and G4 of the first and fourth pixels P1 and P4 have a negative polarity during a first frame. In contrast, the red subpixels R1 and R4 of the first and fourth pixels P1 and P4 have a negative polarity but the green subpixels G1 and G4 of the first and fourth pixels P1 and P4 have a positive polarity during a second frame so that the color difference due to the difference of the luminance of the positive pixel and the luminance of the negative pixel may be generated.

For example, during the first frame, the luminance component of the red subpixels R1 and R4 is relatively higher than the luminance component of the green subpixels G1 and G4 compared to the second frame so that the display panel 100 may display yellow oriented to red.

For example, during the second frame, the luminance component of the green subpixels G1 and G4 is relatively higher than the luminance component of the red subpixels R1 and R4 compared to the first frame so that the display panel 100 may display yellow oriented to green.

FIG. 3C illustrates a cyan check pattern. All subpixels of the second and third pixels P2 and P3 have relatively low grayscales so that the second and third pixels P2 and P3 represent black. Red subpixels R1 and R4 of the first and fourth pixels P1 and P4, respectively, have relatively low grayscales or medium grayscales, but do not have relatively high grayscales. Green and blue subpixels G1, B1, G4, and B4 of the first and fourth pixels P1 and P4 have relatively high grayscales so that the first and fourth pixels P1 and P4 represent cyan. The first to fourth pixels P1 to P4 may represent dark cyan as an average color.

When the display panel 100 represents the cyan checker pattern of FIG. 3C in the relatively low frequency, the blue subpixels B1 and B4 of the first and fourth pixels P1 and P4 have a positive polarity but the green subpixels G1 and G4 of the first and fourth pixels P1 and P4 have a negative polarity during a first frame. In contrast, the blue subpixels B1 and B4 of the first and fourth pixels P1 and P4 have a negative polarity but the green subpixels G1 and G4 of the first and fourth pixels P1 and P4 have a positive polarity during a second frame so that the color difference due to the difference of the luminance of the positive pixel and the luminance of the negative pixel may be generated.

For example, during the first frame, the luminance components of the blue subpixels B1 and B4 are relatively higher than the luminance components of the green subpixels G1 and G4 compared to the second frame so that the display panel 100 may display cyan oriented to blue.

For example, during the second frame, the luminance components of the green subpixels G1 and G4 are relatively higher than the luminance components of the blue subpixels B1 and B4 compared to the first frame so that the display panel 100 may display cyan oriented to green.

Although not shown in FIG. 2, the timing controller 200 may further include a signal generating part.

The signal generating part receives the input control signal CONT. The signal generating part generates the first control signal CONT1 to control a driving timing of the gate driver 300 based on the input control signal CONT and the driving frequency. The signal generating part generates the second control signal CONT2 to control a driving timing of the data driver 500 based on the input control signal CONT and the driving frequency. The signal generating part generates the third control signal CONT3 to control a driving timing of the gamma reference voltage generator 400 based on the input control signal CONT and the driving frequency.

The signal generating part outputs the first control signal CONT1 to the gate driver 300. The signal generating part outputs the second control signal CONT2 to the data driver 500. The signal generating part outputs the third control signal CONT3 to the gamma reference voltage generator 400.

Figure 4:
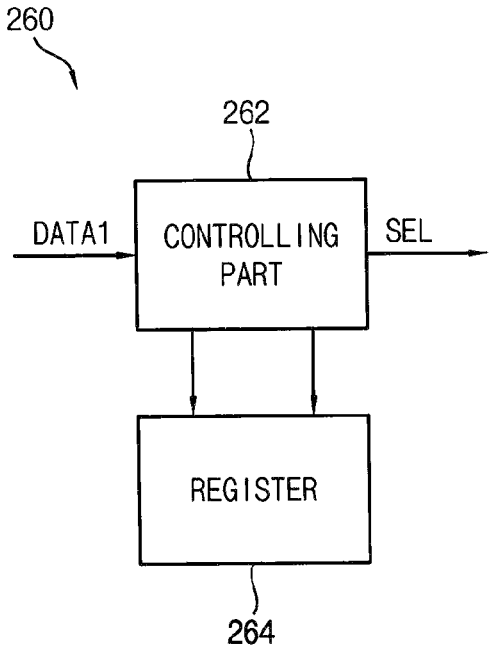
FIG. 4 is a block diagram illustrating the color difference determining part of FIG. 2 according to an exemplary embodiment of the present inventive concept.
Figure 5:
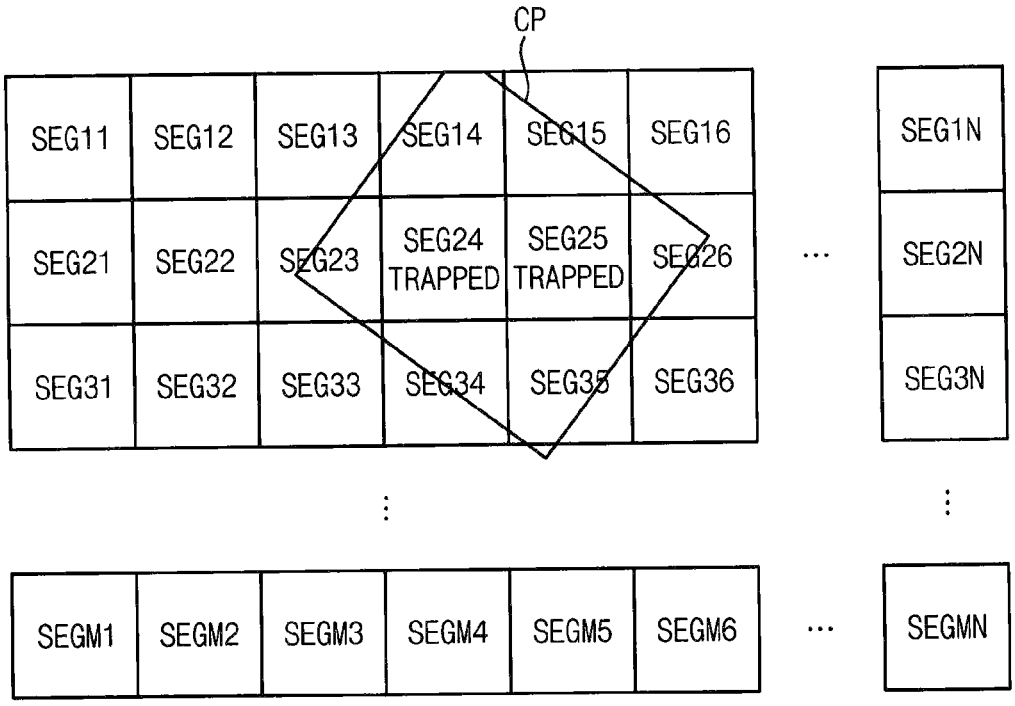
FIG. 5 and FIG. 6 are conceptual diagrams illustrating a method of determining the color difference generating pattern operated by the color difference determining part of FIG. 2 according to an exemplary embodiment of the present inventive concept.
Figure 6:
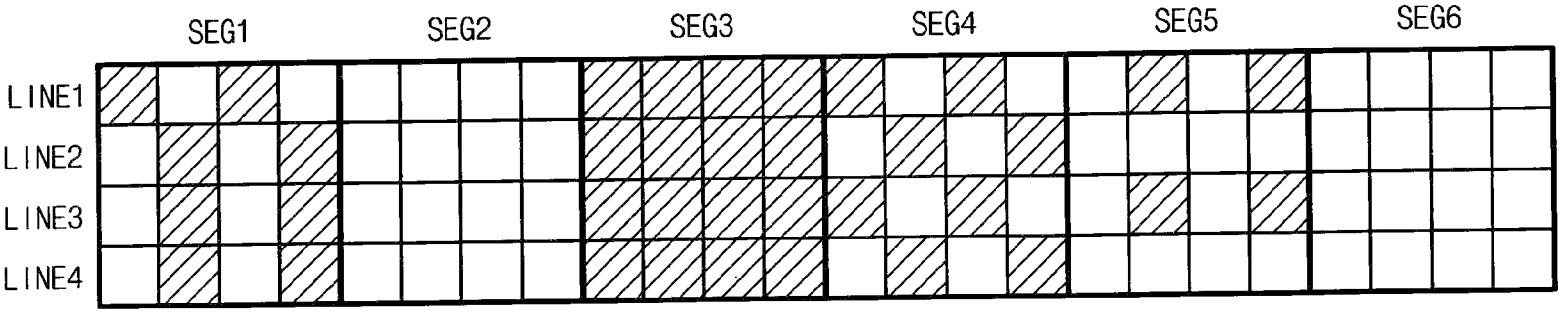

FIG. 4 is a block diagram illustrating the color difference determining part 260 of FIG. 2. FIG. 5 and FIG. 6 are conceptual diagrams illustrating a method of determining the color difference generating pattern operated by the color difference determining part 260 of FIG. 2. FIG. 7A to FIG. 7D are conceptual diagrams illustrating data stored in a register of FIG. 4.

Referring to FIG. 1 to FIG. 7D, the color difference determining part 260 includes a controlling part 262 and a register 264. The controlling part 262 receives the input data signal DATA1, divides the input data signal DATA1 into a plurality of segments SEGs, detects a segment SEG having the color difference generating pattern among the plurality of the segments SEGs and outputs the selection signal SEL. The register 264 stores a segment number which has the color difference generating pattern and a type of the color difference generating pattern row by row.

The segment SEG may include a plurality of groups of pixels. For example, each segment SEG may include sixteen pixels in a four by four matrix. However, aspects are not limited as such. For example, the size of the segment SEG may be properly adjusted. When the size of the segment SEG gets smaller, a relatively small color difference generating pattern may be detected but a processing load and a memory for detecting the color difference generating pattern may increase. In contrast, when the size of the segment SEG gets bigger, a processing load and a memory for detecting the color difference generating pattern may decrease but a relatively small color difference generating pattern may not be detected.

The color difference determining part 260 may determine that the input data signal DATA1 has the color difference generating pattern, when at least one segment SEG has the color difference generating pattern.

An area of the color difference generating pattern is illustrated as CP in FIG. 5. Segments SEG13, SEG14, SEG15, SEG16, SEG23, SEG26, SEG34 and SEG35 partially include the color difference generating pattern so that the segments SEG13, SEG14, SEG15, SEG16, SEG23, SEG26, SEG34 and SEG35 may not be determined as the segments having the color difference generating pattern. Segments SEG24 and SEG25 entirely include the color difference generating pattern so that the segments SEG24 and SEG25 may be determined as the segments having the color difference generating pattern.

According to an aspect, the color difference determining part 260 may determine the input data signal DATA1 to have the color difference generating pattern, when the number of the segments SEG having the color difference generating pattern is equal to or greater than a threshold number.

In FIG. 6 to FIG. 7D, the color difference generating pattern is a white checker pattern and a segment SEG includes sixteen pixels in a four by four matrix.

The controlling part 262 illustrated in FIG. 4 divides each segment SEG into a plurality of rows and determines the color difference generating pattern by comparing adjacent rows in the segment SEG. The register 264 stores a segment number which has the color difference generating pattern and a type of the color difference generating pattern row by row.

In a first row LINE1, a first segment SEG1 has an alternate pattern of low, high, low and high grayscales, a fourth segment SEG4 has an alternate pattern of low, high, low and high grayscales and a fifth segment SEG5 has an alternate pattern of high, low, high and low grayscales.

When the alternate pattern of low, high, low and high grayscales is defined as TYPE 0 and the alternate pattern of high, low, high and low grayscales is defined as TYPE 1, the register 264 stores the segment number and the type of the pattern as shown in FIG. 7A. For example, the register 264 may store the segment number of eight bits and the type of the pattern of a bit.

In a second row LINE2, the first segment SEG1 has an alternate pattern of high, low, high and low grayscales and the fourth segment SEG4 has an alternate pattern of high, low, high and low grayscales.

In the second row LINE2, the first segment SEG1 and the fourth segment SEG4 have alternate patterns and the first segment SEG1 and the fourth segment SEG4 have types of the segment (TYPE1) different from the types of the segment (TYPE0) of the first row LINE1. Thus, the register 264 stores the segment number and the type of the pattern as shown in FIG. 7B.

In a third row LINE3, the first segment SEG1 has an alternate pattern of high, low, high and low grayscales, the fourth segment SEG4 has an alternate pattern of low, high, low and high grayscales, the fifth segment SEG5 has an alternate pattern of high, low, high and low grayscales.

In the third row LINE3, the first segment SEG1 has an alternate pattern of the TYPE1, which is the same as the type of the pattern (TYPE1) of the second row LINE2. Thus, the first segment SEG1 does not have the checker pattern anymore because the alternate pattern type is maintained. Therefore, the register 264 does not store the first segment SEG1.

In the third row LINE3, the fourth segment SEG4 has an alternate pattern of the TYPE0, which is different from the type of the pattern (TYPE1) of the second row LINE2. Thus, the fourth segment SEG4 is stored in the register 264 as shown in FIG. 7C because the alternate pattern type is changed from TYPE1 to TYPE0.

In a fourth row LINE4, the fourth segment SEG4 has an alternate pattern of high, low, high and low grayscales.

In the fourth row LINE4, the fourth segment SEG4 has an alternate pattern and the type of the pattern (TYPE1) is different from the type of the pattern (TYPE0) of the third row LINE3. Thus, the fourth segment SEG4 is stored in the register 264 as shown in FIG. 7D.

When the fourth row LINE 4 of the input data signal DATA1 is scanned, one segment (SEG4) is determined as the segment having the color difference generating pattern so that the color difference determining part 260 may determine the input data signal DATA1 to have the color difference generating pattern without scanning remaining rows of the input data signal DATA1.

The register 264 includes a unit datum having the segment number (e.g. eight bits) and the type of the pattern (e.g. a bit). A size of the register 264 may be adjusted according to the number of unit data. The maximum number of unit data may be set to a quarter of the number of the subpixels (e.g. 1920*3) in a row direction. Alternatively, the number of unit data may be set to eight to twelve to decrease the size of the register 264.

The size of the register 264 may be much smaller than a size of a frame memory or a size of a line memory so that a load and a memory to detect the color difference generating pattern may be reduced.

According to the above described exemplary embodiment, the driving frequency may be adjusted according to the image displayed on the display panel 100 so that the power consumption of the display apparatus may be reduced. In addition, when the input data signal DATA1 includes the color difference generating pattern, the image is displayed in a relatively high frequency so that the color difference recognition by a user may be prevented or reduced. Thus, a display quality of the display panel 100 may be improved.

Figure 8:
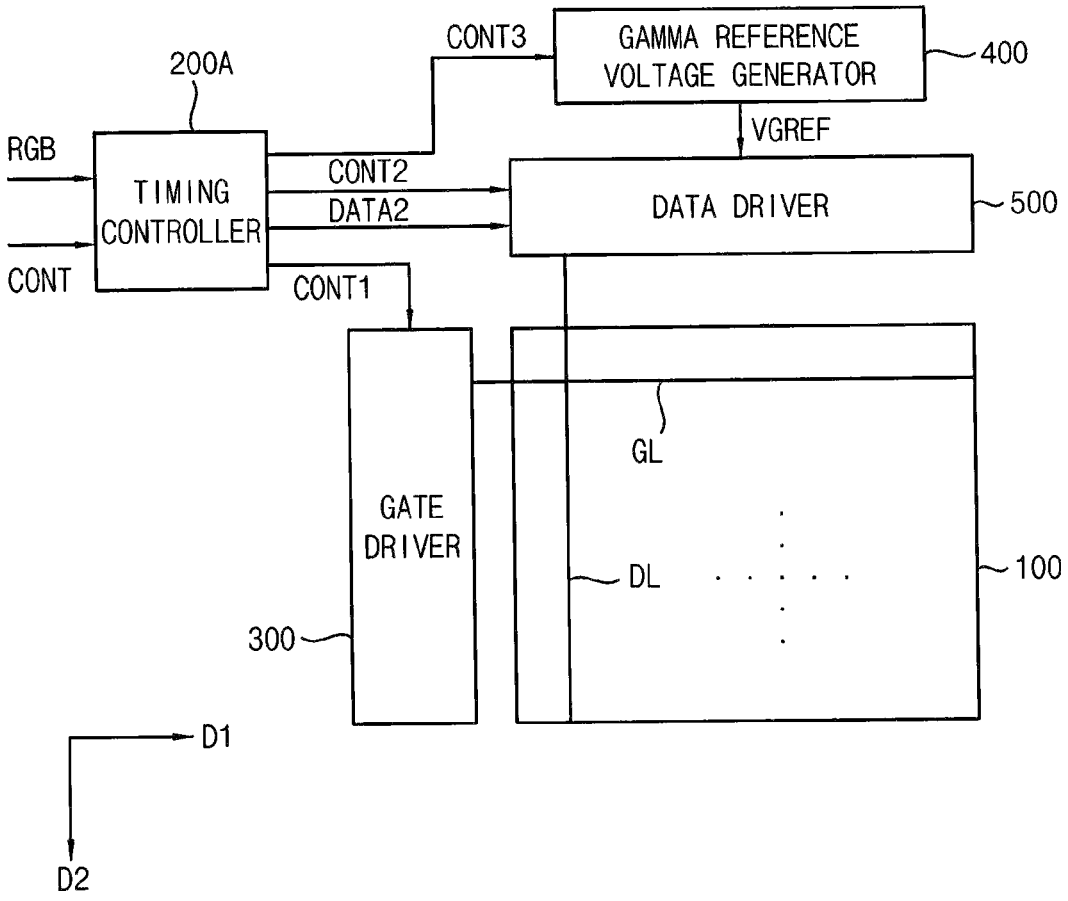
FIG. 8 is a block diagram illustrating a display apparatus according to an exemplary embodiment of the present inventive concept.
Figure 9:
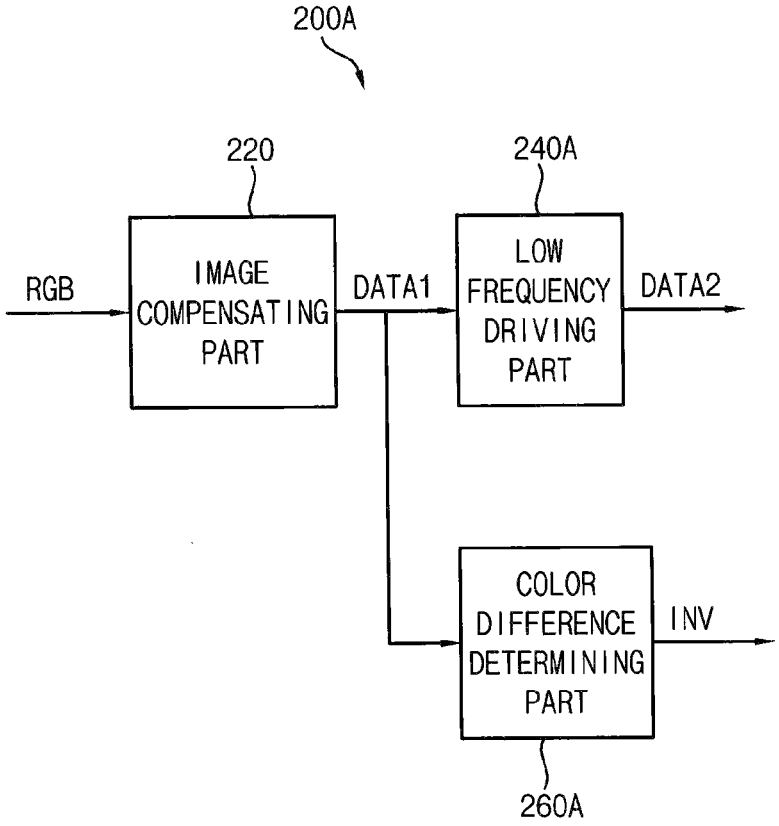
FIG. 9 is a block diagram illustrating a timing controller of FIG. 8 according to an exemplary embodiment of the present inventive concept.
Figure 10:
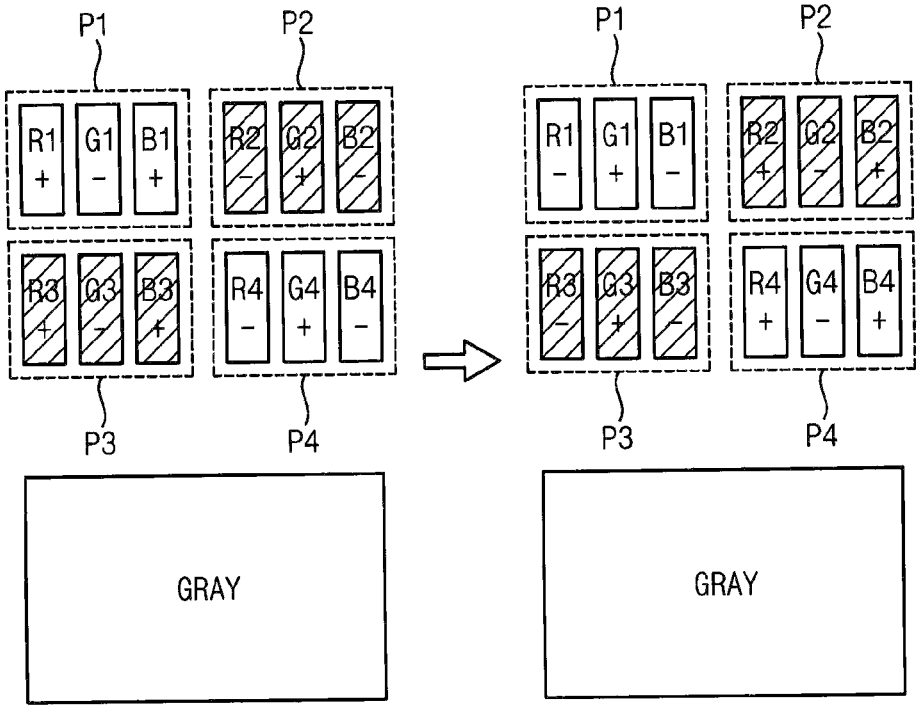
FIG. 10 is a conceptual diagram illustrating an operation of a color difference determining part of FIG. 9 according to an exemplary embodiment of the present inventive concept.

FIG. 8 is a block diagram illustrating a display apparatus according to an exemplary embodiment of the present inventive concept. FIG. 9 is a block diagram illustrating a timing controller 200A of FIG. 8 according to an exemplary embodiment of the present inventive concept. FIG. 10 is a conceptual diagram illustrating an operation of a color difference determining part 260A of FIG. 9 according to an exemplary embodiment of the present inventive concept.

The method of driving the display panel and the display apparatus according to the following exemplary embodiment is substantially the same as the method of driving the display panel and the display apparatus of the previous exemplary embodiment explained with reference to FIG. 1 to FIG. 7D except for the timing controller. Thus, the same reference numerals will be used to refer to the same or like parts as those described in the previous exemplary embodiment of FIG. 1 to FIG. 7D and any repetitive explanation concerning the above elements will be omitted.

Referring to FIG. 8 and FIG. 9, the display apparatus includes a display panel 100 and a panel driver. The panel driver includes a timing controller 200A, a gate driver 300, a gamma reference voltage generator 400, and a data driver 500.

The display panel 100 displays an image. The display panel 100 includes a plurality of gate lines GL, a plurality of data lines DL and a plurality of subpixels connected to the gate lines GL and the data lines DL.

The timing controller 200A generates a first control signal CONT1, a second control signal CONT2, a third control signal CONT3, and a data signal DATA2 based on the input image data RGB and the input control signal CONT.

The timing controller 200A may adjust a driving frequency of the display panel 100 according to determinations whether the input image data RGB represents a video image or a static image and whether the input image data RGB includes the color difference generating pattern or not.

The gate driver 300 generates gate signals driving the gate lines GL in response to the first control signal CONT1 received from the timing controller 200A. The gate driver 300 sequentially outputs the gate signals to the gate lines GL.

The gamma reference voltage generator 400 generates a gamma reference voltage VGREF in response to the third control signal CONT3 received from the timing controller 200A. The gamma reference voltage generator 400 provides the gamma reference voltage VGREF to the data driver 500.

The data driver 500 receives the second control signal CONT2 and the data signal DATA2 from the timing controller 200A, and receives the gamma reference voltages VGREF from the gamma reference voltage generator 400. The data driver 500 converts the data signal DATA2 into data voltages having an analog type using the gamma reference voltages VGREF. The data driver 500 outputs the data voltages to the data lines DL.

Referring to FIG. 9, the timing controller 200A includes an image compensating part 220, a low frequency driving part 240A and a color difference determining part 260A.

The image compensating part 220 compensates grayscale data of the input image data RGB and rearranges the input image data RGB to generate an input data signal DATA1 to correspond to a data type of the data driver 500. The input data signal DATA1 may have a digital type. The image compensating part 220 outputs the input data signal DATA1 to the low frequency driving part 240A.

The low frequency driving part 240A receives the input data signal DATA1. The low frequency driving part 240A determines whether the input data signal DATA1 represents a video image or a static image. When the input data signal DATA1 represents a video image, an intermediate data signal DATA2 having a first frequency is generated. When the input data signal DATA1 represents a static image, an intermediate data signal DATA2 having a second frequency is generated.

For example, the first frequency may be 60 Hz. For example, the second frequency may be 1 Hz. The first frequency and the second frequency may vary according to the image of the input data signal DATA1.

The color difference determining part 260A receives the input data signal DATA1. The color difference determining part 260A determines whether the input data signal DATA1 includes the color difference generating pattern or not. The color difference determining part 260A determines an inversion driving method according to a determination whether the input data signal DATA1 includes the color difference generating pattern or not. The color difference determining part 260A outputs an inverting signal INV representing the inversion driving method.

For example, the inversion method of the display panel 100 may be a dot inversion method. In the dot inversion method, polarity of the data voltage in each subpixel is inverted along the first direction D1 and the second direction D2.

When the input data signal DATA1 includes the color difference generating pattern, the color difference determining part 260A converts the inversion driving method of the display panel 100 from the dot inversion method to a column inversion method to prevent the color difference. In the column inversion method, polarity of the data voltage in each subpixel is inverted along the first direction D1 but polarity of the data voltages are not inverted along the second direction D2.

As a result, when the input data signal DATA1 is a video image, the timing controller 200A determines the driving method of the display panel 100 as the dot inversion method. When the input data signal DATA1 is a static image and the input data signal DATA1 does not have the color difference generating pattern, the timing controller 200A determines the driving method of the display panel 100 as the dot inversion method. When the input data signal DATA1 is a static image and the input data signal DATA1 has the color difference generating pattern, the timing controller 200A determines the driving method of the display panel 100 as the column inversion method.

In FIG. 3A, the display panel 100 is driven in the dot inversion method, the input data signal DATA1 represents white checker pattern. During the first frame, the display panel 100 displays gray oriented to magenta. During the second frame, the display panel 100 displays gray oriented to green.

In FIG. 10, the display panel 100 is driven in the column inversion method, the input data signal DATA1 represents white checker pattern.

During the first frame, the first red subpixel R1, the first blue subpixel B1 and the fourth green pixel G4 of the first and fourth pixels P1 and P4 have a positive polarity but the first green subpixel G1, the fourth red subpixel R4 and the fourth blue pixel B4 of the first and fourth pixels P1 and P4 have a negative polarity. During the first frame, polarities of red, green and blue of the first and fourth pixels P1 and P4 are respectively balanced. Thus, the display panel 100 displays gray having balanced red, green and blue colors during the first frame.

During the second frame, the first red subpixel R1, the first blue subpixel B1 and the fourth green pixel G4 of the first and fourth pixels P1 and P4 have a negative polarity but the first green subpixel G1, the fourth red subpixel R4 and the fourth blue pixel B4 of the first and fourth pixels P1 and P4 have a positive polarity. During the second frame, polarities of red, green and blue of the first and fourth pixels P1 and P4 are respectively balanced. Thus, the display panel 100 displays gray having balanced red, green and blue colors during the second frame.

According to the present exemplary embodiment, the driving frequency may be adjusted according to the image displayed on the display panel 100 so that the power consumption of the display apparatus may be reduced. In addition, when the input data signal DATA1 includes the color difference generating pattern, the inversion driving method of the display panel 100 is converted so that the color difference may be prevented. Thus, a display quality of the display panel 100 may be improved. Thus, the color difference may be reduced by controlling the inversion driving method of the pixels.

If a polarity of a pixel is inverted from a positive polarity to a negative polarity or from the negative polarity to the positive polarity, a color difference may be generated because of the difference between a luminance of the pixel having the positive polarity and a luminance of the pixel having the negative polarity.

However, if polarities of a plurality of pixels are inverted in a specific inversion method for a specific pixel arrangement, an average color difference of the plurality of pixels may not be generated as described above with reference to FIG. 10.

Figure 11:
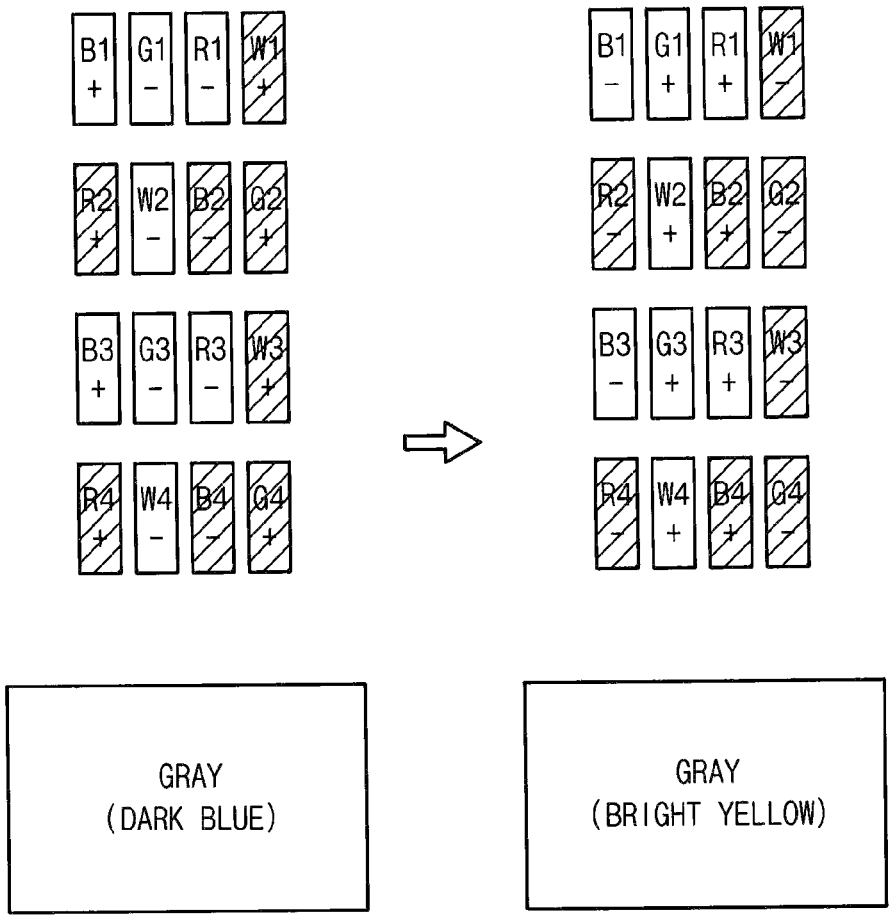
FIG. 11 is a conceptual diagram illustrating a color difference generating pattern determined by a color difference determining part of a display apparatus according to an exemplary embodiment of the present inventive concept.

FIG. 11 is a conceptual diagram illustrating a color difference generating pattern determined by a color difference determining part of a display apparatus according to an exemplary embodiment of the present inventive concept.

The method of driving the display panel and the display apparatus according to the present exemplary embodiment is substantially the same as the method of driving the display panel and the display apparatus of the previous exemplary embodiment explained referring to FIG. 1 to FIG. 7D except for the a pixel structure of the display panel, an inversion driving method, and a color difference generating pattern. Thus, the same reference numerals will be used to refer to the same or like parts as those described in the previous exemplary embodiment of FIG. 1 to FIG. 7D, and any repetitive explanation concerning the above elements will be omitted.

Referring to FIGS. 1, 2, 4, and 11, the display apparatus includes a display panel 100 and a panel driver. The panel driver includes a timing controller 200, a gate driver 300, a gamma reference voltage generator 400, and a data driver 500.

The display panel 100 displays an image. The display panel 100 includes a plurality of gate lines GL, a plurality of data lines DL, and a plurality of subpixels connected to the gate lines GL and the data lines DL.

The timing controller 200 generates a first control signal CONT1, a second control signal CONT2, a third control signal CONT3, and a data signal DATA3 based on the input image data RGB and the input control signal CONT.

The timing controller 200 may adjust a driving frequency of the display panel 100 according to determinations whether the input image data RGB represents a video image or a static image and whether the input image data RGB includes the color difference generating pattern or not.

The gate driver 300 generates gate signals driving the gate lines GL in response to the first control signal CONT1 received from the timing controller 200. The gate driver 300 sequentially outputs the gate signals to the gate lines GL. According to different configurations of the display apparatus, the timing controller 200 may have different configuration, such as the timing controller 200A, for example.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500.

The data driver 500 receives the second control signal CONT2 and the data signal DATA3 from the timing controller 200, and receives the gamma reference voltages VGREF from the gamma reference voltage generator 400. The data driver 500 converts the data signal DATA3 into data voltages having an analog type using the gamma reference voltages VGREF. The data driver 500 outputs the data voltages to the data lines DL.

The timing controller 200 includes an image compensating part 220, a low frequency driving part 240, a color difference determining part 260, and a selecting part 280.

The image compensating part 220 compensates grayscale data of the input image data RGB and rearranges the input image data RGB to generate an input data signal DATA1 to correspond to a data type of the data driver 500. The input data signal DATA1 may have a digital type. The image compensating part 220 outputs the input data signal DATA1 to the low frequency driving part 240.

The low frequency driving part 240 receives the input data signal DATA1. The low frequency driving part 240 determines whether the input data signal DATA1 represents a video image or a static image. When the input data signal DATA1 represents a video image, an intermediate data signal DATA2 having a first frequency is generated. When the input data signal DATA1 represents a static image, an intermediate data signal DATA2 having a second frequency is generated.

The color difference determining part 260 receives the input data signal DATA1. The color difference determining part 260 determines whether the input data signal DATA1 includes the color difference generating pattern or not. The color difference determining part 260 determines a selection signal SEL according to a determination whether the input data signal DATA1 includes the color difference generating pattern or not. The color difference determining part 260 outputs the selection signal SEL to the selecting part 280.

The selecting part 280 receives the input data signal DATA1 from the image compensating part 220, the intermediate data signal DATA2 from the low frequency driving part 240 and the selection signal SEL from the color difference determining part 260. The selecting part 280 selects one of the input data signal DATA1 and the intermediate data signal DATA2 to generate an output data signal DATA3. The selecting part 280 outputs the output data signal DATA3 to the data driver 500.

When the input data signal DATA1 includes the color difference generating pattern, the selecting part 280 selects the input data signal DATA1 having the first frequency as the output data signal DATA3. When the input data signal DATA1 does not include the color difference generating pattern, the selecting part 280 selects the intermediate data signal DATA2 having the second frequency as the output data signal DATA3.

Even though the input data signal DATA1 represents a static image, if the input data signal DATA1 includes the color difference generating pattern, the display panel 100 is driven in a high frequency (e.g. the first frequency) so that the color difference is not recognized by an observer.

In FIG. 11, an odd numbered row of the display panel 100 includes a blue subpixel, a green subpixel, a red subpixel and a white subpixel which are sequentially disposed in the first direction D1. An even numbered row of the display panel 100 includes a red subpixel, a white subpixel, a blue subpixel and a green subpixel, which are sequentially disposed in the first direction D1.

For example, columns of the display panel 100 have polarities of +, −, −, +, +, −, −, + in the first direction D1. The polarity of the data voltages are inverted in every two dots along the first direction D1 but polarity of the data voltages are not inverted along the second direction D2.

When blue subpixel, green subpixel and red subpixel in the odd numbered row and white subpixel in the even numbered row have relatively high grayscales and remaining subpixels have relatively low grayscales, the color difference determining part 260 may detect the color difference generating pattern.

During a first frame, blue subpixels B1 and B3 of the first and third rows have a positive polarity and green and red subpixels G1, R1, G3 and R3 of the first and third rows have a negative polarity. In addition, white subpixels W2 and W4 of the second and fourth rows have a negative polarity. During the first frame, the luminance components of the blue subpixels B1 and B3 are relatively higher than the luminance components of the green, red, and white subpixels G1, R1, W2, G3, R3, and W4 compared to the second frame so that the display panel 100 may display gray oriented to dark blue.

During a second frame, blue subpixels B1 and B3 of the first and third rows have a negative polarity and green and red subpixels G1, R1, G3 and R3 of the first and third rows have a positive polarity. In addition, white subpixels W2 and W4 of the second and fourth rows have a positive polarity. During the second frame, the luminance components of the green, red, and white subpixels G1, R1, W2, G3, R3, and W4 are relatively higher than the blue subpixels B1 and B3 compared to the second frame so that the display panel 100 may display gray oriented to bright yellow.

According to the present exemplary embodiment, the driving frequency may be adjusted according to the image displayed on the display panel 100 so that the power consumption of the display apparatus may be reduced. In addition, when the input data signal DATA1 includes the color difference generating pattern, the image is displayed in a relatively high frequency so that the color difference may be prevented or reduced. Thus, a display quality of the display panel 100 may be improved.

Figure 12:
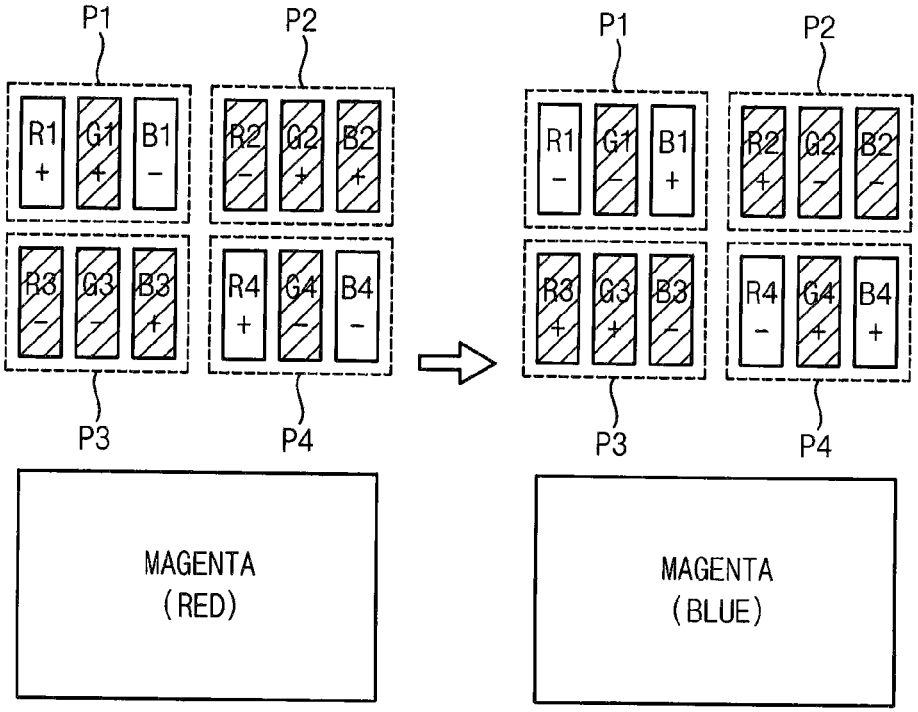
FIG. 12 is a conceptual diagram illustrating a color difference generating pattern determined by a color difference determining part of a display apparatus according to an exemplary embodiment of the present inventive concept.

FIG. 12 is a conceptual diagram illustrating a color difference generating pattern determined by a color difference determining part 260 of a display apparatus according to an exemplary embodiment of the present inventive concept.

The method of driving the display panel and the display apparatus according to the present exemplary embodiment is substantially the same as the method of driving the display panel and the display apparatus of the previous exemplary embodiment explained with reference to FIG. 1 to FIG. 7D except for the a pixel structure of the display panel, an inversion driving method, and a color difference generating pattern. Thus, the same reference numerals will be used to refer to the same or like parts as those described in the previous exemplary embodiment of FIG. 1 to FIG. 7D and any repetitive explanation concerning the above elements will be omitted.

Referring to FIGS. 1, 2, 4, and 12, the display apparatus includes a display panel 100 and a panel driver. The panel driver includes a timing controller 200, a gate driver 300, a gamma reference voltage generator 400, and a data driver 500.

The display panel 100 displays an image. The display panel 100 includes a plurality of gate lines GL, a plurality of data lines DL, and a plurality of subpixels connected to the gate lines GL and the data lines DL.

The timing controller 200 generates a first control signal CONT1, a second control signal CONT2, a third control signal CONT3, and a data signal DATA3 based on the input image data RGB and the input control signal CONT.

The timing controller 200 may adjust a driving frequency of the display panel 100 according to determinations whether the input image data RGB represents a video image or a static image and whether the input image data RGB includes the color difference generating pattern or not.

The gate driver 300 generates gate signals driving the gate lines GL in response to the first control signal CONT1 received from the timing controller 200. The gate driver 300 sequentially outputs the gate signals to the gate lines GL.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500.

The data driver 500 receives the second control signal CONT2 and the data signal DATA3 from the timing controller 200, and receives the gamma reference voltages VGREF from the gamma reference voltage generator 400. The data driver 500 converts the data signal DATA3 into data voltages having an analog type using the gamma reference voltages VGREF. The data driver 500 outputs the data voltages to the data lines DL.

The timing controller 200 includes an image compensating part 220, a low frequency driving part 240, a color difference determining part 260, and a selecting part 280.

The image compensating part 220 compensates grayscale data of the input image data RGB and rearranges the input image data RGB to generate an input data signal DATA1 to correspond to a data type of the data driver 500. The input data signal DATA1 may have a digital type. The image compensating part 220 outputs the input data signal DATA1 to the low frequency driving part 240.

The low frequency driving part 240 receives the input data signal DATA1. The low frequency driving part 240 determines whether the input data signal DATA1 represents a video image or a static image. When the input data signal DATA1 represents a video image, an intermediate data signal DATA2 having a first frequency ("a relatively higher frequency") is generated. When the input data signal DATA1 represents a static image, an intermediate data signal DATA2 having a second frequency ("a relatively lower frequency") is generated.

The color difference determining part 260 receives the input data signal DATA1. The color difference determining part 260 determines whether the input data signal DATA1 includes the color difference generating pattern or not. The color difference determining part 260 determines a selection signal SEL according to a determination whether the input data signal DATA1 includes the color difference generating pattern or not. The color difference determining part 260 outputs the selection signal SEL to the selecting part 280.

The selecting part 280 receives the input data signal DATA1 from the image compensating part 220, the intermediate data signal DATA2 from the low frequency driving part 240, and the selection signal SEL from the color difference determining part 260. The selecting part 280 selects one of the input data signal DATA1 and the intermediate data signal DATA2 to generate an output data signal DATA3. The selecting part 280 outputs the output data signal DATA3 to the data driver 500.

When the input data signal DATA1 includes the color difference generating pattern, the selecting part 280 selects the input data signal DATA1 having the first frequency as the output data signal DATA3. When the input data signal DATA1 does not include the color difference generating pattern, the selecting part 280 selects the intermediate data signal DATA2 having the second frequency as the output data signal DATA3.

Even though the input data signal DATA1 represents a static image, if the input data signal DATA1 includes the color difference generating pattern, the display panel 100 is driven in a high frequency (e.g. the first frequency) so that the color difference is not recognized by an observer.

In FIG. 12, the display panel 100 includes a first pixel P1, a second pixel P2 adjacent to the first pixel P1 in the first direction D1 defined in FIG. 1, a third pixel P3 adjacent to the first pixel P1 in the second direction D2 defined in FIG. 2, a fourth pixel P4 adjacent to the second pixel P2 in the second direction D2.

The first pixel P1 includes a first red subpixel R1, a first green subpixel G1 and a first blue subpixel B1, which are sequentially disposed in the first direction D1.

The second pixel P2 includes a second red subpixel R2, a second green subpixel G2 and a second blue subpixel B2, which are sequentially disposed in the first direction D1.

The third pixel P3 includes a third red subpixel R3, a third green subpixel G3 and a third blue subpixel B3, which are sequentially disposed in the first direction D1.

The fourth pixel P4 includes a fourth red subpixel R4, a fourth green subpixel G4 and a fourth blue subpixel B4, which are sequentially disposed in the first direction D1.

For example, polarity of data voltages is inverted in every two subpixels along the first direction D1 and in every subpixel in the second direction D2.

All subpixels of the second and third pixels P2 and P3 have relatively low grayscales. The green subpixels G1 and G4 of the first and fourth pixels P1 and P4 commonly have relatively low grayscales, and the red subpixels R1 and R4 or the blue subpixels B1 and B4 of the first and fourth pixels P1 and P4 commonly have relatively high grayscales. The color difference determining part 260 may determine the color difference generating pattern.

FIG. 12 illustrates a magenta checker pattern. All subpixels of the second and third pixels P2 and P3 have relatively low grayscales so that the second and third pixels P2 and P3 represent black. Red and blue subpixels R1, B1, R4, and B4 of the first and fourth pixels P1 and P4 have relatively high grayscales so that the first and fourth pixels P1 and P4 represent magenta. The first to fourth pixels P1 to P4 may represent dark magenta an average color.

When the display panel 100 represents the magenta checker pattern of FIG. 12 in the relatively low frequency, the red subpixels R1 and R4 of the first and fourth pixels P1 and P4 have a positive polarity but the blue subpixels B1 and B4 of the first and fourth pixels P1 and P4 have a negative polarity during a first frame. In contrast, the red subpixels R1 and R4 of the first and fourth pixels P1 and P4 have a negative polarity but the blue subpixels B1 and B4 of the first and fourth pixels P1 and P4 have a positive polarity during a second frame so that the color difference due to the difference of the luminance of the positive pixel and the luminance of the negative pixel may be generated.

For example, during the first frame, the luminance components of the red subpixels R1 and R4 are relatively higher than the luminance components of the blue subpixels B1 and B4 compared to the second frame so that the display panel 100 may display magenta oriented to red.

For example, during the second frame, the luminance components of the blue subpixels B1 and B4 are relatively higher than the luminance components of the red subpixels R1 and R4 compared to the first frame so that the display panel 100 may display magenta oriented to blue.

According to the present exemplary embodiment, the driving frequency may be adjusted according to the image displayed on the display panel 100 so that the power consumption of the display apparatus may be reduced. In addition, when the input data signal DATA1 includes the color difference generating pattern, the image is displayed in a relatively high frequency so that the color difference may be prevented or reduced. Thus, a display quality of the display panel 100 may be improved.

According to the present exemplary embodiment, a power consumption of the display apparatus may be reduced and a display quality of the display panel may be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A method of driving a display panel, the method comprising:

determining whether an input data signal represents a video image or a static image;

determining whether the input data signal has a color difference generating pattern, the color difference generating pattern generating a color difference if polarities of associated pixels are inverted; and outputting an output data signal, wherein the output data signal has a first frequency if the input data signal represents a video image, wherein the output data signal has the first frequency if the input data signal represents a static image and the input data signal includes the color difference generating pattern, and wherein the output data signal has a second frequency lower than the first frequency if the input data signal represents a static image and the input data signal does not include the color difference generating pattern.

2. The method of claim 1, wherein the outputting the output data signal comprises:

generating an intermediate data signal, the intermediate data signal having the first frequency if the input data signal represents a video image, and the intermediate data signal having the second frequency if the input data signal represents a static image; and selecting one of the input data signal and the intermediate data signal according to a determination whether the input data signal includes the color difference generating pattern.

3. The method of claim 2, wherein the determination whether the input data signal includes the color difference generating pattern comprises:

dividing the input data signal into a plurality of segments; and detecting a segment having the color difference generating pattern among the plurality of the segments.

4. The method of claim 3, wherein the detecting the segment having the color difference generating pattern comprises:

dividing the segment into a plurality of rows; and determining the color difference generating pattern by comparing adjacent rows in the segment.

5. The method of claim 4, wherein the detecting the segment having the color difference generating pattern comprises:

if a first row of the segment includes a first color difference generating pattern, storing a number of the segment and a type of the first color difference generating pattern of the first row.

6. The method of claim 5, wherein the detecting the segment having the color difference generating pattern comprises:

if a second row of the segment includes a second color difference generating pattern and the type of the second color difference generating pattern of the second row is different from the type of the first color difference generating pattern of the first row, storing the number of the segment and the type of the second color difference generating pattern of the second row.

7. The method of claim 1, wherein the display panel includes a first pixel, a second pixel adjacent to the first pixel in a first direction, a third pixel adjacent to the first pixel in a second direction different from the first direction and a fourth pixel adjacent to the second pixel in the second direction, and the first pixel includes a first red subpixel, a first green subpixel, and a first blue subpixel, which are sequentially disposed in the first direction, the second pixel includes a second red subpixel, a second green subpixel, and a second blue subpixel, which are sequentially disposed in the first direction, the third pixel includes a third red subpixel, a third green subpixel, and a third blue subpixel, which are sequentially disposed in the first direction, and the fourth pixel includes a fourth red subpixel, a fourth green subpixel and a fourth blue subpixel, which are sequentially disposed in the first direction.

8. The method of claim 7, wherein all subpixels of the second and third pixels have substantially low grayscales, the green subpixels in the first and fourth pixels commonly have substantially high grayscales, and the red subpixels and/or the blue subpixels in the first and fourth pixels commonly have substantially high grayscales, and polarities of data voltages are inverted in every subpixel in the first direction and the second direction.

9. A method of driving a display panel, the method comprising:

determining whether an input data signal represents a video image or a static image;

determining whether the input data signal has a color difference generating pattern, the color difference generating pattern generating a color difference if polarities of associated pixels are inverted;

outputting an output data signal; and determining an inversion driving method of the display panel according to the determination whether the input data signal represents a video image or a static image and the determination whether the input data signal includes the color difference generating pattern, wherein the output data signal has a first frequency if the input data signal represents a video image, and wherein the output data signal has a second frequency lower than the first frequency if the input data signal represents a static image.

10. The method of claim 9, wherein the display panel is driven in a dot inversion method if the input data signal represents a video image, the display panel is driven in the dot inversion method if the input data signal represents a static image and the input data signal does not include the color difference generating pattern, and the display panel is driven in a column inversion method if the input data signal represents a static image and the input data signal includes the color difference generating pattern.

11. A display apparatus comprising:

a display panel configured to display an image;

a timing controller configured to determine whether an input data signal represents a video image or a static image, to determine whether the input data signal includes a color difference generating pattern, the color difference generating pattern generating a color difference if polarities of associated pixels are inverted, to output an output data signal; and a data driver configured to generate a data voltage based on the output data signal and to output the data voltage to the display panel, wherein the output data signal has a first frequency if the input data signal represents a video image, wherein the output data signal has the first frequency if the input data signal represents a static image and the input data signal includes the color difference generating pattern, and wherein the output data signal has a second frequency lower than the first frequency if the input data signal represents a static image and the input data signal does not include the color difference generating pattern.

12. The display apparatus of claim 11, wherein the timing controller comprises:

a low frequency driving part configured to generate an intermediate data signal, the intermediate data signal having the first frequency if the input data signal represents a video image, and the intermediate data signal having the second frequency if the input data signal represents a static image;

a color difference determining part configured to determine whether the input data signal includes the color difference generating pattern and to generate a selection signal according to the determination whether the input data signal includes the color difference generating pattern; and a selecting part configured to select one of the input data signal and the intermediate data signal based on the selection signal.

13. The display apparatus of claim 12, wherein the selecting part comprises a multiplexer including a first input terminal configured to receive the input data signal, a second input terminal configured to receive the intermediate data signal, a control signal configured to receive the selection signal, and an output terminal configured to output one of the input data signal and the intermediate data signal.

14. The display apparatus of claim 12, wherein the color difference determining part comprises:

a controlling part configured to divide the input data signal into a plurality of segments and to detect a segment having the color difference generating pattern among the plurality of the segments; and a register configured to store a number of the segment having the color difference generating pattern and a type of the color difference generating pattern.

15. The display apparatus of claim 14, wherein, if a first row of the segment includes a first color difference generating pattern, the controlling part is configured to store a number of the segment and a type of the first color difference generating pattern of the first row, and if a second row of the segment includes a second color difference generating pattern and a type of the second color difference generating pattern of the second row is different from the type of the first color difference generating pattern of the first row, the controlling part is configured to store the number of the segment and the type of the second color difference generating pattern of the second row.

16. The display apparatus of claim 11, wherein the display panel includes a first pixel, a second pixel adjacent to the first pixel in a first direction, a third pixel adjacent to the first pixel in a second direction different from the first direction, and a fourth pixel adjacent to the second pixel in the second direction, and the first pixel includes a first red subpixel, a first green subpixel, and a first blue subpixel, which are sequentially disposed in the first direction, the second pixel includes a second red subpixel, a second green subpixel, and a second blue subpixel, which are sequentially disposed in the first direction, the third pixel includes a third red subpixel, a third green subpixel, and a third blue subpixel, which are sequentially disposed in the first direction, and the fourth pixel includes a fourth red subpixel, a fourth green subpixel, and a fourth blue subpixel, which are sequentially disposed in the first direction.

17. The display apparatus of claim 16, wherein polarities of data voltages are inverted in every subpixel in the first direction and the second direction, and all subpixels of the second and third pixels have substantially low grayscales, the green subpixels in the first and fourth pixels commonly have substantially high grayscales and the red subpixels and/or the blue subpixels in the first and fourth pixels commonly have substantially high grayscales.

18. A display apparatus comprising:

a display panel configured to display an image;

a timing controller configured to determine whether an input data signal represents a video image or a static image, to determine whether the input data signal includes a color difference generating pattern, the color difference generating pattern generating a color difference if polarities of associated pixels are inverted, to output an output data signal, and to determine an inversion driving method of the display panel according to the determination whether the input data signal represents a video image or a static image and the determination whether the input data signal includes the color difference generating pattern; and a data driver configured to generate a data voltage based on the output data signal and to output the data voltage to the display panel, wherein the output data signal has a first frequency if the input data signal represents a video image, and wherein the output data signal has a second frequency lower than the first frequency if the input data signal represents a static image.

19. The display apparatus of claim 18, wherein the timing controller comprises:

a low frequency driving part configured to generate the output data signal having the first frequency if the input data signal represents a video image and to generate the output data signal having the second frequency if the input data signal represents a static image; and a color difference determining part configured to determine the inversion driving method of the display panel to be a dot inversion method if the input data signal represents a video image, to determine the inversion driving method of the display panel to be the dot inversion method if the input data signal represents a static image and the input data signal does not include the color difference generating pattern, and to determine the inversion driving method of the display panel to be a column inversion method if the input data signal represents a static image and the input data signal includes the color difference generating pattern.

* * * * *